US005980392A

United States Patent [19]

Cox

[11] Patent Number: 5,980,392

[45] Date of Patent: Nov. 9, 1999

[54] MOVING PRACTICE GREEN AND BALL PICKUP APPARATUS

[76] Inventor: Alvin Emison Cox, 10612 Hambletonian Pl., Santa Ana, Calif. 92705

[21] Appl. No.: 09/042,311

[22] Filed: Mar. 13, 1998

[51] Int. Cl.[6] ..... A63B 69/36

[52] U.S. Cl. ..... 473/192; 473/167; 473/409; 414/40

[58] Field of Search ..... 473/168–170, 473/173, 190–192, 195, 196, 197, 409, 150, 151; 414/440

[56] References Cited

U.S. PATENT DOCUMENTS

| | | | |
|---|---|---|---|
| 3,231,280 | 1/1966 | Collins | 473/195 |
| 3,520,727 | 7/1970 | Crump | 134/115 |
| 4,045,023 | 8/1977 | Heffley, Jr. | 273/35 |
| 4,202,547 | 5/1980 | Mueller | 273/181 |
| 5,163,677 | 11/1992 | Foley | 273/35 |
| 5,219,161 | 6/1993 | Williams, Sr. | 273/35 |
| 5,234,215 | 8/1993 | Uehara | 273/35 |
| 5,580,320 | 12/1996 | Meikle | 473/197 |

*Primary Examiner*—Mark S. Graham

*Attorney, Agent, or Firm*—William H. Maxwell

[57] ABSTRACT

A movable simulated golf green enables the practicing of approach shots on a golf driving range, or other location. The apparatus is constructed as part of a motorized vehicle so as to be driven about to various selected locations on the range. The green surface is made of a flexible sheet material laid over, but only connected to a structural under layer along its periphery. Thus an air layer pumped between the flexible sheet and the under layer causes the flexible layer to rise to a position slightly above the structural surface. The inner facing surfaces of these layers each have a metallic contact layer on them so that when they contact each other an electrical circuit may be closed. The electrical circuit provides a power source and several lamps for illuminating when a golf ball contacts the green surface and forces the metal layers into contact momentarily. The circuit is compounded so as to indicate by different color lamps, how far the ball impact on the green is from a flagpole positioned on the green. The apparatus also provides a ball pickup device which picks up stray golf balls and deposits them into a bin carried by the apparatus. The device is preferably remote controlled by radio commands from a fixed location and incorporates an on-board controller that steers the device to each new position on the golf range.

8 Claims, 3 Drawing Sheets

MOVING PRACTICE GREEN AND BALL PICKUP APPARATUS

BACKGROUND OF THE INVENTION

1. Field of the Invention

This invention relates generally to golf ball practice ranges and devices for the facilitation thereof, and more particularly to a motorized practice green movable to selected locations on the range for practice of approach shots and further to such an apparatus that further performs the duty of picking up stray golf balls.

2. Description of Related Art

The following art defines the present state of this field:

Uehara, U.S. Pat. No. 5,234,215 describes a golf practicing range that has a guide way provided on a field and a putting green provided on the field. The green is movable intermittently along the guide way. At each tee there is provided a distance indicator which displays the distance from the tee to the green every time the green stops at a predetermined point on the guide way.

Mueller, U.S. Pat. No. 4,202,547 describes a movable golf green which is movable along a predetermined track and the golf green is rotatable to provide a multitude of golf green simulation layouts and changing pin positions to the user of the apparatus.

Foley, U.S. Pat. No. 5,163,677 describes a golf-driving range for driving golf balls from any of a series of tee-points grouped together to a single common golf-driving fairway having a plurality of spaced apart greens each with a flagged hole, with preferably one of the greens being surrounded by a man-made pond of water, with also the plurality of greens being separated from the driving tee-points by a stream of water, and with sand traps and with assorted trees, shrubs and/or simulations thereof positioned preferably heterogeneously on the fairway, with at-least two sand traps positioned adjacent each of the spaced-apart greens, and a collection device including a centrifugal pump and a channeling device for separating and collecting golf ball that have fallen into the pond water, and detection and indicator mechanisms indicating onto which green a golf ball falls.

Williams. Sr, U.S. Pat. No. 5,219,161 describes an apparatus adapted for use as a green on a golf driving range wherein golf balls which land on the apparatus are prevented from remaining thereon. The apparatus includes a golf green surface having a perimeter in the shape of a golf green and an interiorly located cup opening The apparatus includes self-clearing means for preventing golf balls which land on the golf green surface so that golf balls inherently roll off of the green or by providing a mechanism which raises and lowers one end of the green surface in order to clear balls therefrom. The self-clearing green is well-suited for use on golf driving ranges where the clutter of golf balls on target greens reduces the value of the green as a realistic target for golfers using the range.

Meikle, U.S. Pat. No. 5,580,320 describes an artificial golf green designed for use at driving ranges. The target green structure is formed at an incline to provide users of the golf range the appearance of much larger target surface due to the perspective effects when viewing an inclined object from a distance. The construction of the target green is sectional to facilitate transportation. The landing surface includes artificial turf and energy absorbing pad for more realistic performance.

W.B. Crump, U.S. Pat. No. 3,520,727 describes forwardly divergent arms, held rigidly so as to form a throat at a conveyor frame, so as to swamp the balls on the ground toward an inclined table. A belt conveyor superimposed on the inclined table grips the balls and rolls them up the table so that the balls drop into a container, in which latter there are ball-carrying cages immersed in water. The golf balls are washed during the collecting operation by the forward motion and rocking of the container the unit is pulled by any suitable means such as by a motorized vehicle which is suitable tied to a cross bar connecting the divergent arms at their widest spaced end.

Heffley, Jr., U.S. Pat. No. 4,045,023 describes a game apparatus comprising a target with a plurality of target zones each of which is operatively connected to an impact responsive signal generator, a signal selecting circuit and a scoreboard by which objects impacting upon the target produce signals above an adjustable level that will register on the scoreboard. In a specific embodiment, the target may take the form of a simulated golf green and is combined with an all-weather golf driving range including a driving booth in which the environment is controlled, a fairway designed such that snow removal and ball retrieval are enhanced, and a device for registering the longer drives.

The prior art teaches the use of a movable simulated golf green and also teaches the use of golf ball pickup vehicles. However, the prior art does not teach a motorized golf green, ball picker combination. The present invention teaches such an apparatus and provides further related advantages as described in the following summary.

SUMMARY OF THE INVENTION

The present invention teaches certain benefits in construction and use which give rise to the objectives described below.

The present invention provides a movable simulated golf green of a size making it practical for practicing approach shots on a golf driving range, or other location. The apparatus is constructed as part of a motorized vehicle so as to be driven about to various selected locations on the range. The green surface is made of a flexible sheet material laid over, but only connected to a structural under layer along its periphery. Thus an air layer pumped between the flexible sheet and the under layer causes the flexible layer to rise to a position slightly above the structural surface. The inner facing surfaces of these layers each have a metallic contact layer on them so that when they contact each other an electrical circuit may be closed. The electrical circuit provides a power source and several lamps for illuminating when a golf ball contacts the green surface and forces the metal layers into contact momentarily. The circuit is compounded so as to indicate by different color lamps, how far the ball impact on the green is from a flagpole positioned on the green. The flagpole is supported by the green in an upright position and the lamps are supported on the pole so as to be visible from a tee area of the driving range. Because a momentary lighting of a lamp may not be adequately visible, the circuit includes timing latching relays to provide a selectable lamp illumination duration for each ball strike. The apparatus also provides a ball pickup device which picks up stray golf balls and deposits them into a bin carried by the apparatus. When the apparatus is moved from one position to the next on the range, it picks up all stray golf balls laying in its path as it travels about. The device is preferably remote controlled by radio commands from a fixed location and incorporates an on-board controller that steers the device to each new position on the golf range.

A primary objective of the present invention is to provide a remote controlled, motorized golf green and golf ball pickup combination apparatus having advantages not taught in the prior art.

Another objective is to provide such an apparatus having the ability to detect when a golf ball strikes the golf green surface and to illuminate a lamp indication thereof.

A further objective is to provide such an apparatus that indicates how far the golf ball strike is from a flagpole on the green.

A still further objective is to provide such an apparatus having a programming capability so as to enable the apparatus to learn a series of positions and stall times which when put together is able to cover any driving range efficiently while picking up golf balls effectively.

A yet further objective is to provide such an apparatus having the ability to be positioned in any orientation with respect to the direction in which golf balls are projected on a practice range.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a moving golf practice green and golf ball pickup apparatus for use in a golf practice park such as a golf ball driving range or other golf related setting.

The apparatus is comprised of an engine driven vehicle 1 having a propulsion means 3. This propulsion means 3 is preferably, but is not limited to, either a two or four stroke gasoline or other fuel-powered engine or an electric motor, and in fact may be built on any one of a variety of existing gasoline, or pressurized gas, or electric golf course type vehicles such as a motorized golf cart.

Figure 1:
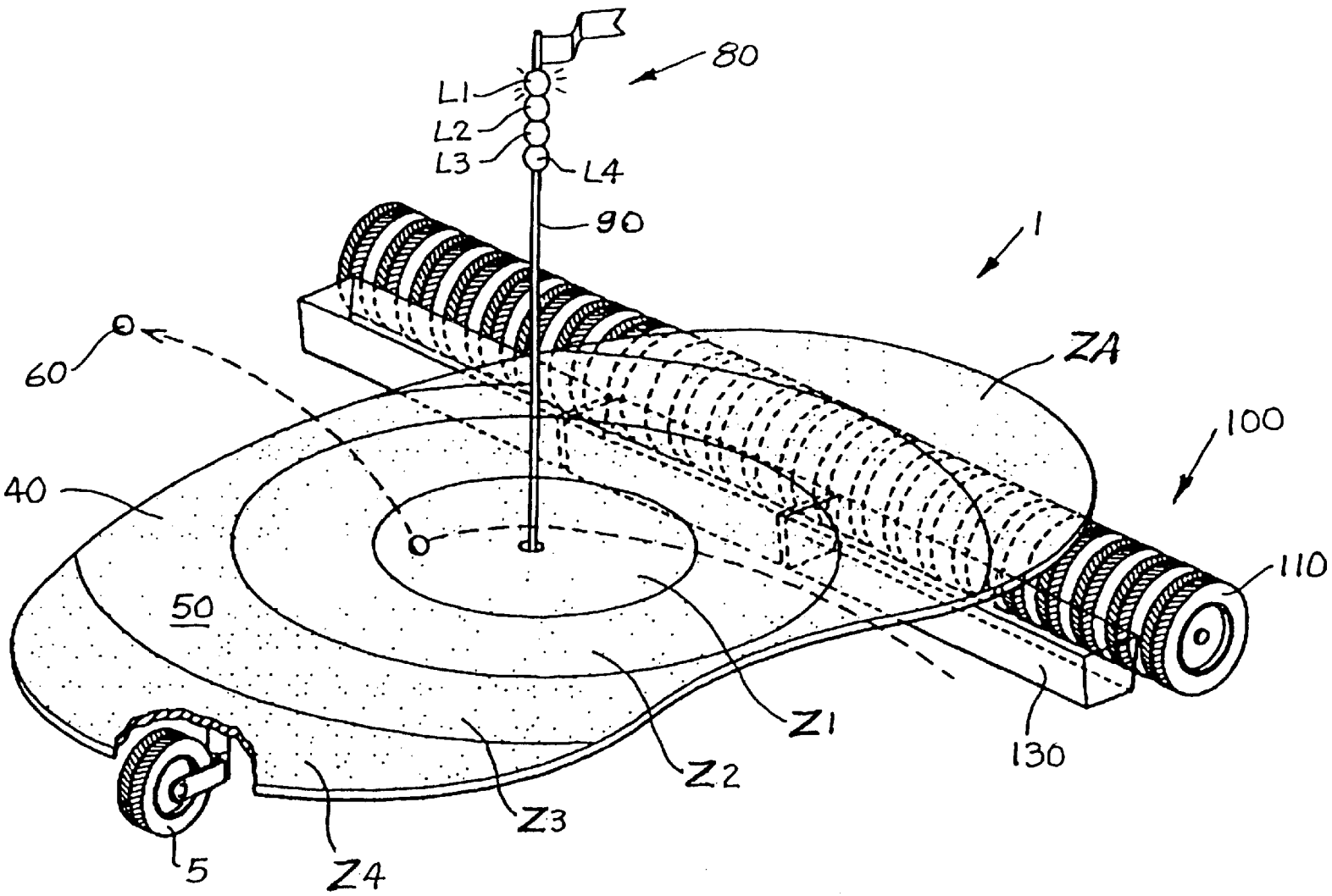
FIG. 1 is a perspective view of the preferred embodiment of the present invention.

The apparatus further includes a steering means 5. The steering means 5 is preferably, either a simple chain drive, a rack and pinion arrangement, or other mechanical drive of any common type well known in the art. The vehicle 1 may provide four wheels or three as shown in FIG. 1. The steering means 5 enables the vehicle 1 to be directed to a desired location on the golf park and to move around in tight quarters as for parking and garaging and, as such, the steering means 5 generally includes a steering rotation of up to 90 degrees to either side of straightforward.

Movement of the apparatus is preferably controlled by a remote control means 10 through the use of any type of wave energy such as radio, sound or light energy. This is accomplished by positioning a wave energy receiver 4 on board the apparatus and a wave energy transmitter 2 at any fixed location within the transmitting range of the apparatus. Preferably a computer system functionally operates the transmitter and provides course programming and directing of the apparatus. In such a system, the apparatus is moved by manual direction over a desired course using the fixed site transmitter, i.e., from one selected position to another and by way of desired paths between the selected positions. The set of selected positions and paths, then, makes up a desired programmed course which is set into the computer's memory. The computer system preferably has the ability to store a number of such programs and the ability to select a desired one of the programs at any time. Such remote control systems with one, or two-way wireless transmission are well known in the art and so are not further detailed in this specification. The apparatus provides, appropriate on board servo-controls for automatic engine startup, drive engagement, velocity control and steering so as to be able to follow the program directions from the computer system. In an alternate embodiment of the invention, the apparatus provides a cab for manual driving. The cab (not shown) may be used instead of the remote control version, or in addition to the remote control version. In a still further embodiment, the apparatus may carry, on board, the computer system for programming and directing the apparatus whereby no wireless communication is necessary.

Figures 2A, 2B, 2C:
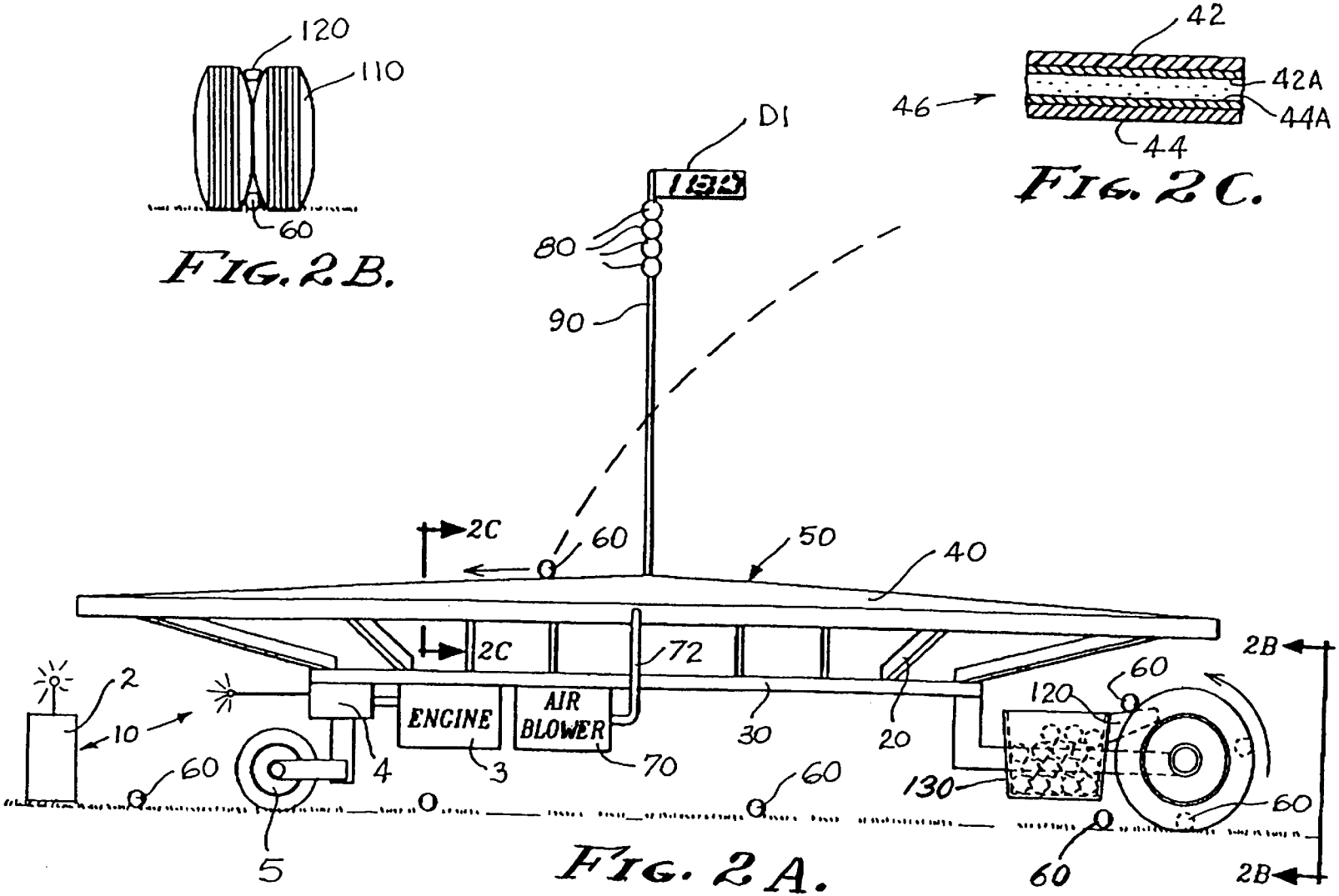
FIG. 2A is a side elevational view thereof.
FIG. 2B is a detailed view taken as indicated by line 2B—2B on FIG. 2A.
FIG. 2C is a detailed view taken as indicated by line 2C—2C on FIG. 2A.
Figure 3:
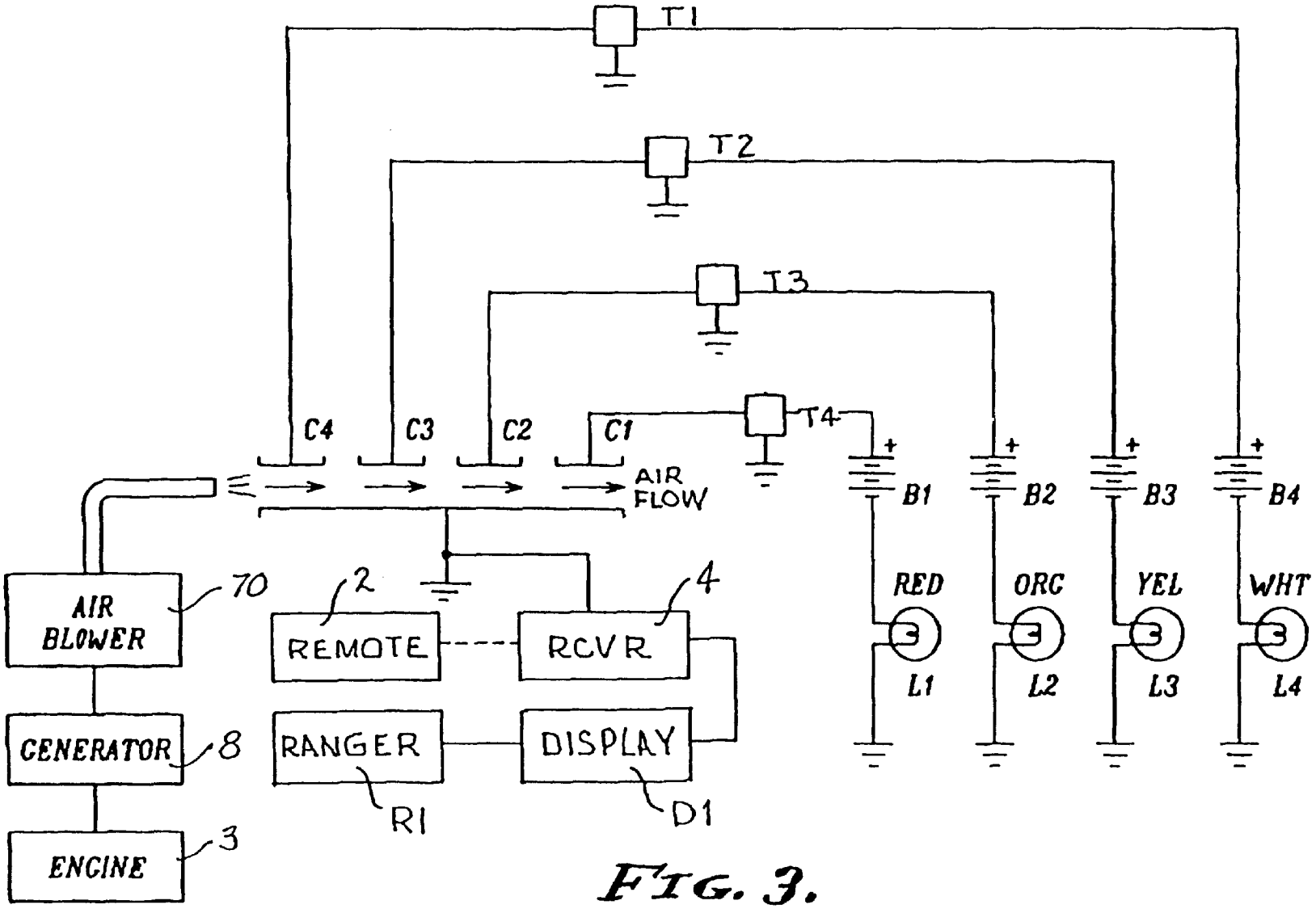
FIG. 3 is an electrical schematic diagram thereof.

The apparatus (FIG. 2A) provides a mat support structure 20 preferably comprised of a plurality of rigid struts of either wood, metal, or structural plastic elements, extending upwardly from a baseplate 30 as best shown in FIG. 2A. The mat support structure 20 supports a golf ball impact mat 40 positioned over, and held in place by the mat support structure 20 so as to present an upwardly facing ball contact surface 50 of the impact mat 40 for visually simulating a golf green and for receiving golf balls 60 which are hit from positions (not shown) remote to the apparatus for golf training exercise. The golf ball impact mat 40 is preferably comprised of a top layer 42 and a bottom layer 44 (FIG. 2C) that provide a golf ball impact sensing means 46. The top layer 42 is a flexible, light-weight, sheet material such as a plastic or rubber sheet stock. It has bonded to it, or alternately impregnated into it, an electrically conductive surface layer 42A. The conductive surface layer 42A may be a single contiguous layer, or preferably may be broken into several zones Z1, Z2, Z3, and Z4, such as shown in FIG. 1, wherein each of the zones is a separate electrical circuit as shown in FIG. 3 as C1, C2, C3, and C4 respectively. The bottom layer 44 is preferably a rigid sheet or plate and is held rigidly in place on the mat support structure 20. It, too, provides a conductive surface or overlayer 44A and this layer is preferably connected to an electrical ground or return path as shown in FIG. 3. Such electrical surfaces are preferably electroplated, painted or otherwise placed onto the top and bottom layers in face-to-face adjacency. The top and bottom layers 42, 44 are joined peripherally so that they are maintained in position, one over the other.

The apparatus further provides an air blower means 70 joined to the impact mat 40 so as to force air between the top and bottom layers 42, 44 of the impact mat 40 causing these layers to lay slightly apart during operation of the apparatus, i.e., the layers therefore are not in electrical contact (FIG. 2C). The air blower means 70 is preferably an air moving fan or impeller which sends air through at least one short plastic duct 72 in order to maintain a layer of air preferably of between ¼ and ¾ inches between the top and bottom layers 42, 44 of the impact mat. Thus, the mat 40 provides an electrical contact means or impact sensing means 46 formed on the layers and movable therewith such that with the layers forced apart, the electrical contact layers open the circuits C1–C4, and with any one of the layers forced into contact by a golf ball impact on the top layer 42, the respective electrical contact layer closes the circuit momentarily so as to illuminate a lamp means 80 as shown in FIGS. 1 and 2A. When the top and bottom layers 42, 44 are separated by the air from the blower means, the top layer 42 assumes a slight incline away from a flagpole 90 so that golf balls 60 landing on it tend to roll off and onto the ground as shown in FIG. 2A. Alternative means for maintaining the two layers apart, other than an air layer, will be obvious to those skilled in the art and such are incorporated in the present invention. Further, alternative means for detecting the impact of a golf ball on the impact mat will be obvious to those skilled in the art and such are incorporated in the present invention.

In the preferred embodiment of the invention, the impact sensing means 46 includes a plurality of separate impact sensing circuits C1–C4, each positioned at a selected distance from the flagpole 90 of the golf ball impact mat 40. Each of the impact sensing circuits is interconnected with one of a plurality of lamps L1–L4 of the lamp means 80. One of the lamps, of a selected distinctive color, is illuminated by each of the golf ball impacts on the impact sensing means 46 so as to indicate a distance from the flagpole 90 that said impact occurred. In the preferred embodiment, a red color lamp L1 is used to indicate an impact closest to the flagpole. A orange color lamp L2 is used to represent the next closest circular region to the flagpole on the impact mat. A yellow color lamp L3 represents the next closest circular region followed by a white colored lamp L4. These lamps are preferably four separate lamps attached to the flagpole 90 with the red lamp L1 on top or alternately may be one lamp outer cover element with four separate colored bulbs within. The lamp means 80 is part of the electrical circuit of FIG. 3, which also includes an energy storage means B1–B4, such as storage batteries, and a latching timer means T1–T4 of any common latch circuit well known in the art. The electrical circuit is interconnected with the golf ball impact sensing means 46 (C1–C4) such that the impact of a golf ball landing on the impact mat 40 enables the circuit means 46 for illuminating the lamp means L1 or L2 or L3 or L4 for a predetermined time period of preferably, but not limited to, 1 second. All four bulbs flash simultaneously for some seconds prior to the apparatus moving to its next location. The energy storage means is preferably recharged by an electrical generator 8 powered by the propulsion means 3. The electric circuit may further include a means for detecting R1 the distance between the vehicle 1 and the remote control transmitter 2 which is preferably located at the site where the golf balls are hit, and may be any standard radio beacon range finder R1 well known in the art, see "Ranger" in FIG. 3, and a means for displaying the distance D1 as shown in FIGS. 2A and 3. As shown in FIG. 3, the distance of the vehicle 1 from the tee positions is continuously displayed by display D1. When the vehicle is moved to a new location, the display will, again, display the new range so that golfers will know the distance to the pin.

The apparatus preferably includes a golf ball pickup and storage means 100, such as the SL90 Series, Model #71875 of Wittek, Inc., adapted for moving with the vehicle and positioned for picking up golf balls 60 laying on the ground surface of the golf practice park. The golf ball pickup and storage means 100 includes, as is well known in this industry, a plurality of adjacent wheels 110 in contact with the ground surface of the golf practice park. These wheels 110 help support the apparatus. The wheels are spaced apart for wedging golf balls therebetween as the wheels move past the golf balls resting upon the ground surface (FIG. 2B). A picking means 120 extends between each set of the wheels 110 for forcing the golf balls 60 wedged therebetween into a golf ball storage means 130, typically an elongate bin as best seen in FIG. 1. The picking means 120 is a series of arms that extend out from the storage means 130. The golf ball pickup and storage means 100 has been adapted by fixing it to the mat support structure 20 and baseplate 30 for supporting and moving with the vehicle and it is positioned for receiving golf balls that land on, and then fall to the ground around the apparatus. All of the components of the apparatus, are made of appropriate structural materials suitable for the operation of the apparatus as described.

In operation, the moving golf practice green and golf ball pickup apparatus is moved to various positions around the golf park for practicing green approach golf shots. As defined, the apparatus is programmed to stop at designated points along a proposed route, such as, but not limited to, a path of concentric rectangles or a series of spiral shaped paths etc. Preferably, the apparatus is programmed to stop at each pre-determined point for between 4 and 8 minutes before moving on to its next point but this is arbitrary, so that, for instance the apparatus may also be used by parking it at a desired location permanently, or by allowing it to creep along without stopping at all. The apparatus may further be moved continuously for picking up golf balls on the ground surface in a remotely controlled, or internally controlled, or manually driven, pre-programmed, or random, pattern as a simple ball retrieval system.

The invention is intended to fully automate the use of a movable green on a golf driving range. Its secondary function, that of picking up golf balls, enables the invention to replace existing golf ball pickers. Preferably, an underground golf ball retrieval system could be employed so that the invention, when the golf ball storage means is filled, could be parked over a designated drop location whereupon the storage means would drop its contents and the balls would be automatically transferred to a ball driving tee location for reuse. Such a system might employ vacuum suction technique for moving the balls inexpensively and efficiently through conduits. In this manner, the system would be fully automatic from the placement of golf balls for hitting of the balls by driving range customers, to the retrieval for reuse much like the system well known in the bowling industry.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A moving golf practice green and golf ball pickup apparatus for use in a golf practice park, the apparatus comprising:

a vehicle having a propulsion means, a steering means and a mat support structure, the vehicle being movable across a ground surface of the golf practice park;

a golf ball impact mat positioned over the mat support structure, and held in place by the mat support structure so as to present an upwardly facing ball contact surface of the impact mat for visually simulating a golf green, the impact mat providing a golf ball impact sensing means;

a golf ball pickup means adapted for picking up golf balls laying on the ground surface of the golf practice park as the vehicle moves past the golf balls;

a golf ball storage means adapted for moving with the vehicle and positioned for receiving the golf balls from the golf ball pickup means;

an electrical circuit including energy storage means and lamp means, the electrical circuit being interconnected with the golf ball impact sensing means such that the impact of a golf ball landing on the impact mat enables the electrical circuit for momentarily illuminating the lamp means;

whereby the apparatus may be moved to a position for practicing green approach golf shots and the apparatus may further be moved continuously for picking up golf balls on the ground surface.

2. The apparatus of claim 1 wherein the electrical circuit further includes a latching timer means functional for enabling illumination of the lamp means for a predetermined time after each golf ball impact on the impact mat.

3. The apparatus of claim 1 wherein the golf ball pickup means includes a plurality of adjacent wheels in contact with the ground surface of the golf practice park, the wheels being spaced apart for wedging golf balls therebetween as the wheels move past golf balls resting upon the ground surface, a picking means extending between the wheels for forcing golf balls wedged therebetween into the golf ball storage means.

4. The apparatus of claim 1 wherein the impact sensing means includes a plurality of separate impact sensing circuits each positioned at a selected distance from a flagpole of the golf ball impact mat, each of the impact sensing circuits being interconnected with one of a plurality of lamps of the lamp means such that one of the lamps is illuminated by each of the golf ball impacts on the impact sensing means so as to indicate a distance from the flagpole said impact occurred.

5. The apparatus of claim 4 wherein each one of the lamps is a selected distinctive color.

6. The apparatus of claim 1 wherein the golf ball impact mat comprises a top layer and a bottom layer, the apparatus further providing an air blower means joined to the impact mat so as to force air between the top and bottom layers of the impact mat so as to force said layers apart, the mat further providing an electrical contact means formed on the layers and movable therewith such that with the layers forced apart, the electrical contact means on the layers open the circuit, and with the layers forced into contact by a golf ball impact on the top layer, the electrical contact means closing the circuit so as to illuminate the lamp means.

7. The apparatus of claim 1 further including a remote control means for enabling the apparatus to self position within the golf practice park over a series of pre-selected positions and to delay between each of the pre-selected positions.

8. The apparatus of claim 7 further including a means for detecting the distance between the vehicle and the remote control means and a means for displaying said distance.

* * * * *